US007448782B2

(12) United States Patent
Strazzanti

(10) Patent No.: US 7,448,782 B2
(45) Date of Patent: Nov. 11, 2008

(54) THERMOIONIC VEHICLE LAMP ASSEMBLY

(75) Inventor: Michael Strazzanti, Gates Mills, OH (US)

(73) Assignee: Illume, L.L.C., Cleveland, OH (US)

( * ) Notice: Subject to any disclaimer, the term of this patent is extended or adjusted under 35 U.S.C. 154(b) by 0 days.

(21) Appl. No.: 11/952,060

(22) Filed: Dec. 6, 2007

(65) Prior Publication Data

US 2008/0137359 A1 Jun. 12, 2008

Related U.S. Application Data

(60) Provisional application No. 60/868,763, filed on Nov. 6, 2006.

(51) Int. Cl.
*F21V 29/00* (2006.01)

(52) U.S. Cl. ..... 362/547; 362/539

(58) Field of Classification Search ..... 362/538, 362/539, 547

See application file for complete search history.

(56) References Cited

U.S. PATENT DOCUMENTS

| | | | | |
|---|---|---|---|---|
| 4,987,343 | A * | 1/1991 | Kosmatka et al. | 315/82 |
| 5,632,870 | A | 5/1997 | Kucherov | |
| 5,644,184 | A | 7/1997 | Kucherov | |
| 5,653,800 | A | 8/1997 | Kucherov et al. | |
| 5,792,256 | A | 8/1998 | Kucherov et al. | |
| 6,396,191 | B1 | 5/2002 | Hagelstein et al. | |
| 6,489,704 | B1 | 12/2002 | Kucherov et al. | |
| 6,779,347 | B2 | 8/2004 | Kucherov et al. | |
| 6,906,449 | B2 | 6/2005 | Kucherov et al. | |
| 6,946,596 | B2 | 9/2005 | Kucherov et al. | |
| 7,109,408 | B2 | 9/2006 | Kucherov et al. | |
| 2004/0012973 | A1 * | 1/2004 | Baker et al. | 362/464 |

* cited by examiner

*Primary Examiner*—Laura Tso

(57) ABSTRACT

An improved vehicle lamp assembly having a vehicle light bulb and a bulb shield which absorbs heat generated by the vehicle light bulb. The bulb shield is interconnected with a thermoionic (thermionic) device for producing electric current generated as a result of the heat generation and absorption. The thermoionic device redirects the electric current produced to the vehicle lamp assembly or another vehicle electrical system.

6 Claims, 1 Drawing Sheet

THERMOIONIC VEHICLE LAMP ASSEMBLY

CROSS-REFERENCE TO RELATED APPLICATION

The present application claims priority from U.S. patent application Ser. No. 60/868,763, filed Nov. 6, 2006, the entire subject matter of which is incorporated herein by reference.

BACKGROUND OF THE INVENTION

1. Field of Invention

The present invention relates to a vehicle lamp assembly, and to vehicle bulb shield components, and more specifically to a vehicle bulb shield component of a lamp assembly which includes a thermoionic device to improve the energy efficiency of the vehicle headlamp assembly.

2. Background of the Related Art

Thermoionic devices and thermal diodes employ the combination of two semiconductor materials to convert heat into electricity. Recent advances in such devices have realized levels of efficient heat to electrical power conversion as high as 18%, at temperatures between 200 and 300 degrees centigrade. These devices are based on two semiconductors fixed to opposite sides of a barrier layer. One of the semiconductor materials is doped so it is electron rich while the other is depleted of electrons. When installed into an environment where the electron rich semiconductor is a warmer temperature than the temperature of the electron depleted semiconductor, an electrical power flow can be produced. The amount of electrical power produced is related to the difference in temperature between the two semiconductors. A wire lead from each semiconductor serves as the conduit for this electrical power.

Vehicle headlamps are generally comprised of a light source or bulb, an optical reflector, a lens, and in some instances a bulb shield. The purpose of the bulb shield is to control the headlamp light output. To control headlamp output, the bulb shield is placed in close proximity to the headlamp light bulb and therefore reaches temperatures between 200 ad 300 degrees centigrade. Convection of heat from the headlamp light bulb, and bulb shield produces areas of elevated temperature in the headlamp assembly, primarily the areas directly above the light bulb and shield.

The present application provides an improved vehicle headlamp assembly which incorporates thermoionic devices into headlamp assemblies to allow the headlamp to function with a significantly lower draw on the vehicle's electrical power system, which reduced electrical power requirement improves the overall energy efficiency of the vehicle headlamp assembly and the vehicle.

BRIEF SUMMARY OF THE INVENTION

The present application discloses an improved vehicle headlamp assembly having a thermoionic device to convert heat from the headlamp light bulb into electrical energy to assist with the operation of the headlamp light bulb. Thermoionic energy conversion is a method of converting heat energy directly into electrical energy by thermoionic emission. In the process, electrons are thermoionically emitted from the surface of the metal bulb shield during heating of the metal bulb shield as a result of, and during, operation of the vehicle headlamp light bulb.

In the present improved headlamp assembly, the thermoionic device consists of an electrode connected to a heat source which is the hot interior of the bulb shield, a second electrode connected to a heat sink at the cooler exterior of the bulb shield is separated from the first electrode by an intervening space, leads connect the electrodes to the electrical power system, all within the substantially enclosed vehicle headlamp assembly of the optical reflector and lens, which may be sealed in a conventional manner. The heat source supplies heat at a sufficiently high temperature to one electrode, the emitter, from which electrons are thermionically evaporated into the space. The electrons move through this space toward the other electrode, the collector, which is kept at a lower temperature near the heat sink. There the electrons condense and return to the hot electrode via the electrical leads and the electrical load or electrical power system, connected between the emitter and the collector. The flow of electrons through the electrical load is sustained by the temperature difference between the electrodes.

Thermoionic devices as described in U.S. Pat. No. 6,906,449 can be attached to, or formed as an integral part of, the headlamp assembly in several ways. The devices can be attached by high temperature thermal adhesives, physical mounting features, or press fit in a form matching or cooperating with that of the interior or exterior of various headlamp assembly components. As the bulb shield absorbs heat from the light bulb, or bulb shield, the thermoionic device begins to produce electric current. The electrical power coming from the thermoionic devices are routed back to the light bulb, directly or through electrical drive circuitry to other electrical vehicle systems.

The electrical power produced by the thermal diodes or thermoionic devices is generated from otherwise wasted heat, producing a novel headlamp that improves vehicle energy efficiency.

DETAILED DESCRIPTION OF THE INVENTION

Figure 1:
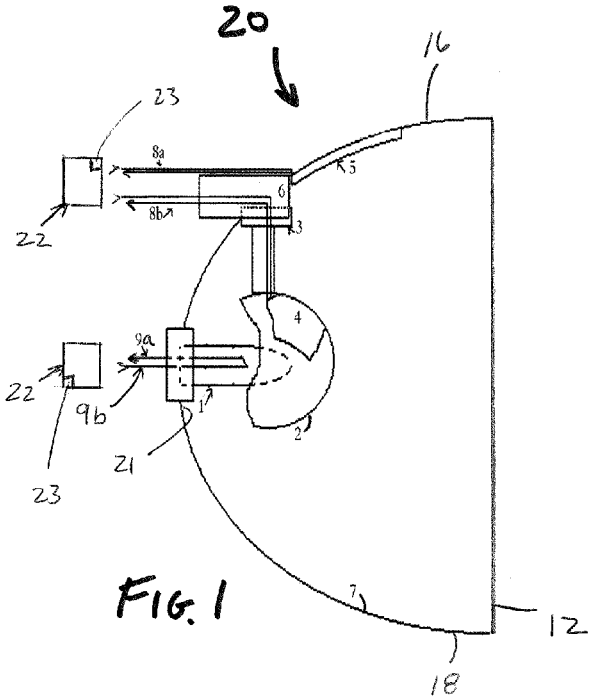
FIG. 1 shows a schematic side view of the improved thermoionic headlamp assembly of the present application.

The present application provides an improved vehicle headlamp assembly of the type generally used in vehicle headlamps to control photometric output. As shown in the attached Figures, the depicted vehicle headlamp assembly 20 employs lens member 12 sealed to a mating reflector member 7 about the periphery thereof. Reflector 7 is in the shape of a paraboloidal reflector intersected by planes forming top, bottom, left and right side walls, of which only top wall 16 and bottom wall 18 are illustrated in FIG. 1. The inner surface of reflector 7 is provided with a coating C of a suitable light-reflecting material such as aluminum or silver. Located in the region of focus of the paraboloidal rear reflecting surface 21 formed by reflector 7 is a hermetically sealed electric vehicle lamp bulb or light bulb 1 which is connected by lead-in conductors 9*a* and 9*b* to contacts (not shown) within the vehicle electrical power system 22, in a manner well known in the art. The lamp bulb 1 may be of a conventional halogen or other configuration.

Figure 2:
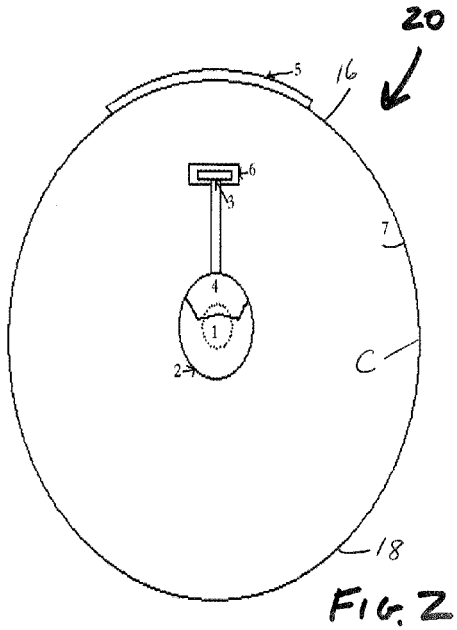
FIG. 2 shows a schematic front view of an alternate headlamp assembly design.

In accordance with the present improved device, the vehicle headlamp assembly 20 is also provided with a light and heat intercepting bulb shield 2 to partially envelop the lamp bulb 1 in a particular manner. During operation of the lamp forward and rearwardly projecting light rays or photometric output from the lamp bulb 1, are/is emitted toward the bulb shield 2 and reflector 7. By reason of its physical location and physical dimensions the depicted bulb shield 2 is thereby positioned to intercept substantially all forwardly projected light rays while still enabling the rearwardly projected light rays not intercepted to reach the reflector 7. FIGS. 1 and 2 illustrate side and front views of the location of components within the headlamp assembly 20. The light bulb 1 is mounted to the optical reflector 7 at the rear reflecting surface 21. The bulb shield 2 is installed in front of the light bulb by an attachment fixture 6 molded into the optical reflector. Wire leads 9*a* and 9*b* provide the required drive voltage for the light bulb 1 from the vehicle's electrical power system, shown schematically at reference number 22. The bulb shield 2 is connected to the attachment fixture 6 by a foot feature 3 which can be attached by employing either press-fit, screw, or locking mechanical features.

Attached to the bulb shield 2 is a thermal diode or thermoionic device 4. Devices of this type, and of the type shown in U.S. Pat. Nos. 6,906,449 and 7,109,408, are available from ENECO, Inc., Salt Lake City, Utah. As shown in FIGS. 1 and 2, a secondary thermal diode or thermoionic device 5 is also affixed to the optical reflector 7 above or otherwise away from the light bulb/bulb shield components at a cooler position within the assembly, at least with respect to the temperature at the position of the thermoionic device 4, which is at a hot location. Wire leads 8*b* from the thermal diode or thermoionic device are routed out of the headlamp assembly to an electrical drive circuit 23 which forms part of the vehicle electrical power system 22. The locations of the thermoionic devices 4 reaches elevated temperatures as high as 200 degrees Celsius as a result of heat convection from the bulb shield and light bulb. Wire leads 8*a* and 8*b* deliver the electricity produced by devices 4, 5 to the electrical drive circuit 23. The thermoionic chips 4,5 give off a lot of current but at a low voltage, so multiple devices or chips may be attached to a mounting plate to obtain a higher voltage. Thus, for example, if one device 4, 5 or chip were to provide 80 millivolts at 3 amps, 8 chips might be used to obtain 6.4 volts.

FIGS. 1-4 depict bulb shields with thermal diodes or thermoionic devices 4, 5 installed in various locations. The bulb shield 2 design is affected by the optical requirements of the lamp bulb 1, mechanical strength requirements of the headlamp assembly, and cosmetic considerations. Therefore each bulb shield 2 will reach different temperatures at different locations. For example, in FIG. 1 the bulb shield 2 is shown with a thermal diode, or thermoionic device installed on the top portion of the bulb shield. This area will generally be the hottest area of the bulb shield 2 due to convection of heat from the light bulb 1. However, bulb shields 2 are commonly coated with high temperature light absorbing black paint on their interior surface (not illustrated). This paint serves to absorb light emitted by the light bulb 1. Were this light not absorbed, the reflection of it may reach the optical reflector 7 and alter the headlamp beam or photometric output in an undesirable way. The absorption of light from the light bulb 1 by the black paint or coating causes the areas of the bulb shield which are coated to reach higher temperatures than the unpainted areas.

Figure 3:
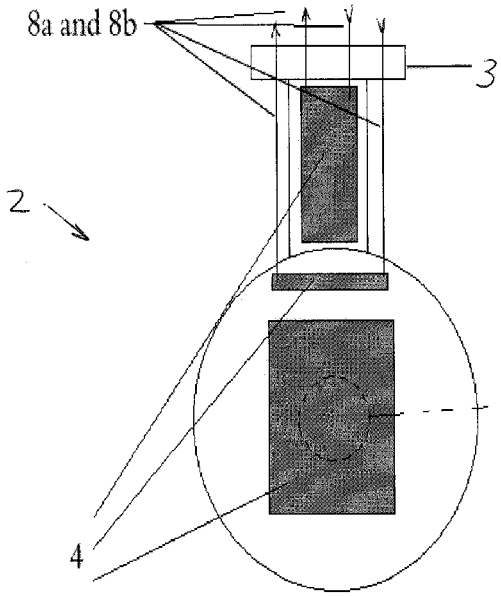
FIG. 3 shows a schematic front view of a bulb shield of the type used within the improved headlamp assembly of the present application.

FIG. 3 depicts a design situation where the black paint is applied only to the interior front portion of the bulb shield. This condition will cause the front of the bulb shield 2 to reach higher temperatures than other areas. Therefore, the thermal diode or thermoionic device 4 is affixed to the front portion of the bulb shield 2.

FIG. 3 also depicts thermal diodes or thermoionic devices 4 applied to portions of the bulb shield 2 above the light bulb 1 location, indicating a situation where a combination of multiple thermal diodes or thermoionic devices 4 are installed. Wire leads 8*a* and 8*b* deliver the electrical power produced by the thermal diodes or thermoionic devices 4 to the electrical drive circuit 23.

Figure 4:
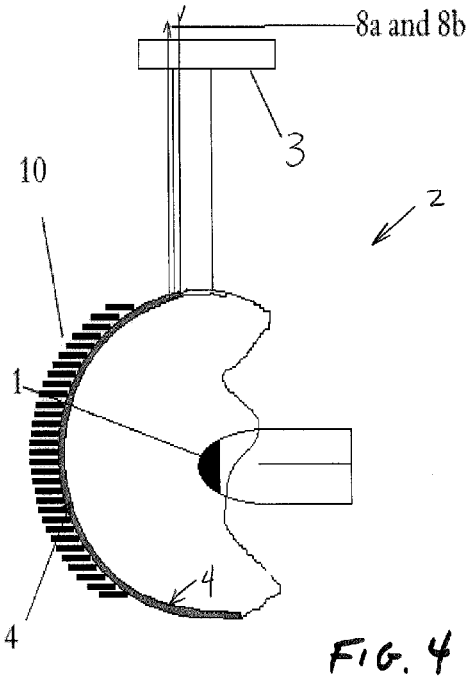
FIG. 4 shows a schematic side view of an alternate bulb shield having alternate thermoionic devices within the headlamp assembly of the present application.

FIG. 4 depicts a bulb shield 2 with a thermoionic device 4 formed into a shape to match that of the bulb shield 2. This method of construction serves to maximize the surface area of the thermoionic device without affecting the bulb shield 2 geometry. Additionally, a heat sink 10, may be applied to the exterior of device 4 to improve the variance in temperature between the two semiconductors (i.e. the bulb facing semiconductor of device 4 is warmer than the semiconductor in contact with the heat sink). Such heat sink devices are available from CeramTec AG, in Princeton, N.J. See their website information concerning products: http://wwww.ceramtec-.com/index/products/ceramcool_ceramic_heatsink/01113, 0123,0453,0740.p hp. A similar heat sink could also be applied to the thermoionic device 5, as shown in FIGS. 1 and 2, internally or externally of the reflector 7. The function of the heat sink is to increase the differential in temperature between the thermoionic device positioned at the hot location and the thermoionic device positioned at the cold location within the device. While the use of a heat sink is optional, its use increases the efficiency of the thermoionic devices or chips to a useful level.

While different embodiments of the invention have been described in detail here, it will be appreciated by those of skill in the art that various modifications and alternatives to the embodiments could be developed in light of the overall teachings of the disclosure. Accordingly, the particular devices and arrangements are illustrative only and are not limiting as to the scope of the invention which is to be given the full breadth of any and all equivalents thereof.

The invention claimed is:

1. A vehicle lamp assembly having a vehicle light bulb and a bulb shield that absorbs heat generated by said vehicle light bulb, said bulb shield is interconnected with a thermoionic device for producing electric current generated from the heat generation and absorption by the bulb shield, said thermoionic device redirecting the electric current produced to a vehicle electrical power system.

2. The vehicle lamp assembly of claim 1 further comprising an optical reflector and lens substantially surrounding said vehicle light bulb, bulb shield and thermoionic device.

3. The vehicle lamp assembly of claim 2 further comprising a heat sink spaced from said light bulb.

4. The vehicle lamp assembly of claim 3 wherein said heat sink is located within and substantially surrounded by said optical reflector and lens.

5. A vehicle bulb shield for absorbing heat generated from a vehicle lamp bulb, said bulb shield engaged with a thermoionic device for producing electric current from the heat absorbed by said bulb shield.

6. The vehicle bulb shield of claim 5 wherein the electric current produced from said thermoionic device is redirected to a vehicle electrical power system.

* * * * *